US006159291A

United States Patent [19]

Morita et al.

[11] Patent Number: 6,159,291

[45] Date of Patent: Dec. 12, 2000

[54] SUBSTRATE TREATING APPARATUS

[75] Inventors: Akihiko Morita; Joichi Nishimura; Masami Ohtani, all of Kyoto, Japan

[73] Assignee: Dainippon Screen Mfg. Co., Ltd., Japan

[21] Appl. No.: 09/131,558

[22] Filed: Aug. 10, 1998

[30] Foreign Application Priority Data

Aug. 11, 1997 [JP] Japan ..... 9-216533
Sep. 18, 1997 [JP] Japan ..... 9-253258

[51] Int. Cl.[7] ..... B05B 13/02

[52] U.S. Cl. ..... 118/321; 118/52; 118/320; 118/323; 427/240

[58] Field of Search ..... 118/52, 320, 321, 118/323, 681; 427/240, 425; 901/43; 15/77, 88.2, 102

[56] References Cited

U.S. PATENT DOCUMENTS 4,132,938 1/1979 Sano et al. ..... 318/568
4,987,851 1/1991 Yasuda et al. ..... 118/403
5,016,567 5/1991 Iwabuchi et al. ..... 118/733
5,089,305 2/1992 Ushijima et al. ..... 427/422
5,324,547 6/1994 Ohhashi et al. ..... 427/479
5,514,215 5/1996 Takamatsu et al. ..... 118/313
5,685,039 11/1997 Hamada et al. ..... 15/88.2
5,772,764 6/1998 Akimoto ..... 118/319
5,853,812 12/1998 Kawasaki et al. ..... 427/421
5,863,328 1/1999 Sichmann et al. ..... 118/52

*Primary Examiner*—Shrive Beck
*Assistant Examiner*—Jennifer Calcagni
*Attorney, Agent, or Firm*—Ostrolenk, Faber, Gerb & Soffen, LLP

[57] ABSTRACT

A substrate treating apparatus for treating a substrate in a predetermined substrate treating region. Each holder arm is supported in a proximal end portion thereof by an arm support to be swingable about a pivotal axis. In time of substrate treatment, the arm support is raised by an air cylinder. With the ascent of the arm support, a cam follower attached to a proximal end of the holder arm is guided by a cam groove. The holder arm, while being raised, turns from a vertical standby posture to a horizontal posture for treating the substrate. As a result, a treating device attached to a distal end of the holder arm moves to a treating position. In the treating position, the treating device treats the substrate. The holder arms are maintained in the vertical standby posture when out of use in substrate treatment. Thus, the holder arms require a reduced standby space.

19 Claims, 14 Drawing Sheets

6
7
7a
7b
7c
8
9
13
13a
14

SUBSTRATE TREATING APPARATUS

BACKGROUND OF THE INVENTION (1) Field of the Invention

The present invention relates to substrate treating apparatus for resist-coating, developing, cleaning or otherwise treating substrates such as semiconductor wafers, glass substrates for photomasks, glass substrates for liquid crystal displays, substrates for optical disks and the like, by supplying thereto a treating liquid such as a photoresist solution, developer or deionized water. More particularly, the invention relates to a technique of accommodating holder arms supporting treating devices such as treating solution supply nozzles or brushes.

(2) Description of the Related Art

Conventional substrate treating apparatus will be described hereunder, taking, for example, apparatus for supplying a resist to substrates such as semiconductor wafers to coat the wafers with the resist.

Conventional resist coating apparatus may be classified broadly into two types as shown in FIGS. 1 and 2.

(1) A resist coating apparatus of the first type will be described with reference to FIG. 1. Numeral 1 denotes a spin chuck for rotatably supporting a wafer W to be treated. The wafer W is surrounded by a scatter preventive cup 2 for preventing scattering of the resist. In a standby position laterally of the scatter preventive cup 2 are a plurality of, e.g. five, holder arms A–E of different lengths having treating solution supply nozzles Na–Ne attached to distal ends thereof for supplying the resist to the wafer W. These five holder arms A–E are arranged parallel to one another and in descending order of length toward the scatter preventive cup 2. The respective holder arms A–E are swingable in a horizontal plane about proximal ends Pa–Pe.

A given one of these five holder arms A–E, e.g. the holder arm B, operates as follows. The holder arm B is first raised from the standby position to a height for movement. The holder arm B raised is swung in the horizontal plane, whereby the treating solution supply nozzle Nb attached to the distal end thereof is moved to a position over the spin center of wafer W. Next, the holder arm B is lowered to lower the treating solution supply nozzle Nb to a resist discharge position. The resist is supplied in a predetermined quantity to the wafer W from the treating solution supply nozzle Nb in the discharge position. When the resist has been supplied, the wafer W is spun at high speed to form a uniform resist layer on its surface. Subsequently, the holder arm B is raised to the height for movement, swung back toward the standby position, and lowered to the standby position which completes the series of processes.

The holder arms A, C, D and E are operable in the same way as the holder arm B.

(2) A resist coating apparatus of the second type will be described with reference to FIG. 2. In a standby position laterally of a scatter preventive cup 2 are a plurality of, e.g. five, holder arms A–E of the same length having treating solution supply nozzles Na–Ne attached to distal ends thereof. These five holder arms A–E are arranged parallel to one another with the distal ends pointing toward the spin chuck 1. The holder arms A–E are mounted on a uniaxial drive mechanism 91. The uniaxial drive mechanism 91 is slidable in directions perpendicular to a longitudinal direction of holder arms A–E. Each holder arm A–E is slidable longitudinally thereof.

A given one of these five holder arms A–E, e.g. the holder arm E, operates as follows. First, the uniaxial drive mechanism 91 slides to move the holder arm E into alignment with the spin center of spin chuck 1. Then, the holder arm E is driven to slide longitudinally thereof from the standby position to move the treating solution supply nozzle Nb to a discharge position over the spin center of wafer W. The resist is supplied in a predetermined quantity to the wafer W from the treating solution supply nozzle Nb in the discharge position. When the resist has been supplied, the wafer W is spun at high speed to form a uniform resist layer on its surface. Subsequently, the holder arm E is driven to slide back to the standby position, to complete the series of processes. The holder arms A–D are operable in the same way as the holder arm E.

The foregoing conventional apparatus have disadvantages as set out hereunder.

Each of the two conventional apparatus provides a standby space laterally of a substrate treating region enclosed by the scatter preventive cup 2. In the standby space, the holder arms are arranged in horizontal posture and extend in the same direction. This arrangement results in a large area within the substrate treating apparatus occupied by the standby space. Especially, with the recent trend toward increased sizes of semiconductor wafers, the holder arms inevitably have extended lengths which require an enlarged standby space. In addition, to achieve improved efficiency of treatment and to enable use of plural types of treating solutions, a single apparatus is required to include multiple treating devices available for selective use. The number of holder arms for individually supporting these treating devices tends to increase, which also is a factor to enlarge the standby space.

SUMMARY OF THE INVENTION

The present invention has been made having regard to the state of the art noted above, and its object is to provide a substrate treating apparatus for allowing a reduction in size of a holder arm standby space.

The above object is fulfilled, according to the present invention, by a substrate treating apparatus for treating a substrate in a predetermined substrate treating region, comprising a holder arm having a treating device attached to a distal end thereof for treating the substrate; and an arm drive device for maintaining the holder arm on standby in a substantially upstanding posture in a standby position separate from the substrate treating region when the holder arm is out of use in substrate treatment, and for turning the holder arm to a substantially lying posture to move the treating device to a position for treating the substrate in time of substrate treatment.

When out of use in substrate treatment, the holder arm supporting the treating device at the distal end thereof stands by in a substantially upstanding posture in a position separate from the substrate treating region. When treating the substrate, the arm drive device turns the holder arm from the substantially upstanding posture to the substantially lying posture to move the treating device at the distal end of the holder arm to the substrate treating position. In the lying posture of the holder arm, the treating device treats the substrate.

As noted above, the holder arm stands by in the substantially upstanding posture when out of use in substrate treatment, and is turned to the substantially lying posture for treating the substrate. Thus, the holder arm on standby requires a reduced standby space, particularly when seen in plan view. Even where the holder arm has an extended length for treating a large substrate, the standby space remains the same in plan view. Consequently, the substrate treating apparatus has a compact overall construction even for treating large substrates.

In the apparatus according to the present invention, preferably, the holder arm is maintained on standby in the substantially upstanding posture in the standby position laterally of the substrate treating region when the holder arm is out of use in substrate treatment, and turned to the substantially lying posture, by being raised and swung from the standby position, to move the treating device to the position for treating the substrate in time of substrate treatment.

The holder arm is maintained on standby in the substantially upstanding posture in the standby position laterally of the substrate treating region. When treating the substrate, the arm drive device turns the holder arm to the substantially lying posture by raising and swinging the holder arm.

This construction allows the holder arm standby space to have a reduced height while having a reduced area in plan view. Thus, the substrate treating apparatus may be constructed to have a minimal height.

Preferably, the arm drive device comprises a lift mechanism engaged with a proximal end portion of the holder arm for raising and lowering the holder arm while allowing a swing of the holder arm, an arm guide member disposed adjacent the holder arm in the standby position and defining a cam groove extending substantially vertically for guiding the holder arm in turning from the substantially upstanding posture to the substantially lying posture, and a cam follower attached to a position adjacent a proximal end and displaced from a pivotal axis of the holder arm for moving along the cam groove.

When the lift mechanism maintains the holder arm in a lower limit position, i.e. in the standby position, the cam follower attached to the proximal end of the holder arm is located in a lower position of the cam groove. In this state, the holder arm takes the substantially upstanding posture, with the distal end thereof raised. When treating the substrate, the lift mechanism raises the holder arm. As a result, the cam follower moves upward along the cam groove to raise the proximal end of the holder arm, thereby tilting the distal end of the holder arm forward. When the cam follower reaches an upper limit position of the cam groove, the holder arm takes the substantially lying posture for treating the substrate.

Thus, the arm drive device may have a simple construction for diminishing the holder arm standby space, and reducing the height of the standby space as well. As a result, the substrate treating apparatus is manufactured at low cost.

The apparatus according to the present invention, preferably, further comprises a treating device posture control device for varying a mounting angle of the treating device with respect to the holder arm with variations in posture of the holder arm.

With this construction, the posture of the treating device attached to the holder arm is variable with variations in the posture of the holder arm.

Thus, the treating device may be set to a desired posture in response to a posture of the holder arm.

The treating device posture control device, preferably, comprises a rotational support mechanism for rotatably connecting the treating device to the holder arm, a first pulley operatively connected to the rotational support mechanism, a second pulley fixed to a pivotal axis adjacent a proximal end of the holder arm, and an endless belt wound around the first pulley and the second pulley.

When the holder arm is turned gradually from the upstanding posture to the lying posture, a relative rotation occurs between the holder arm and the second pulley fixed to the pivotal axis adjacent the proximal end of the holder arm since the second pulley is not rotatable. When the holder arm is swung leftward about the pivotal axis, the second pulley rotates rightward relative to the holder arm. The relative rotation of the second pulley is transmitted to the first pulley through the endless belt. As a result, the first pulley rotates in the same direction as the second pulley, i.e. in the opposite direction to the swing of the holder arm. An amount of rotation of the first pulley is transmitted to the treating device through the rotational support mechanism. As a result, the treating device swings in the opposite direction to the swing of the holder arm. The posture of the treating device is controlled in this way.

Thus, a simple construction is provided for controlling the posture of the treating device in response to variations in the posture of the holder arm.

Preferably, the apparatus according to the present invention comprises a plurality of holder arms arranged in an arcuate form around the substrate treating region.

Plural types of treating devices may be provided for the plurality of holder arms arranged in the arcuate form. When a selected holder arm is turned to the lying posture, the treating device attached to the distal end thereof reaches the treating position centrally of the substrate treating region.

Thus, simply by turning each holder arm to the substantially lying posture, the treating device attached to the distal end of the holder arm may be set to the position for treating the substrate. The plurality of holder arms require a reduced standby space.

In a further aspect of the present invention, a substrate treating apparatus for treating a substrate in a predetermined substrate treating region, comprises a plurality of holder arms arranged radially around the substrate treating region, and each having a treating device attached to a distal end thereof for treating the substrate; and an arm drive device for moving each of the holder arms to set the treating device to a position for treating the substrate.

A plurality of holder arms, each having a treating device attached to the distal end thereof for treating the substrate in the predetermined substrate treating region, are arranged radially around the substrate treating region. The arm drive device moves each of the holder arms arranged radially, to set the treating device attached to the distal end of the holder arm to the position for treating the substrate.

This construction realizes a diminished standby space for maintaining the plurality of holder arms on standby.

Preferably, the arm drive device is operable for maintaining the holder arms on standby in a substantially horizontal posture in the standby position separate from the substrate treating region when the holder arms are out of use in substrate treatment, and for moving each of the holder arms straight to set the treating device to the position for treating the substrate in time of substrate treatment.

The arm drive device advances each holder arm straight from the horizontal standby posture to move the treating device supported by the holder arm to the position for treating the substrate.

This construction, while realizing a diminished standby space for the plurality of holder arms, requires only a drive mechanism for moving the holder arms straight. The holder arm drive mechanism may have a simplified construction. Thus, the entire apparatus may be constructed compact.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Preferred embodiments of the present invention will be described in detail hereinafter with reference to the drawings.

<First Embodiment>

Figure 1:
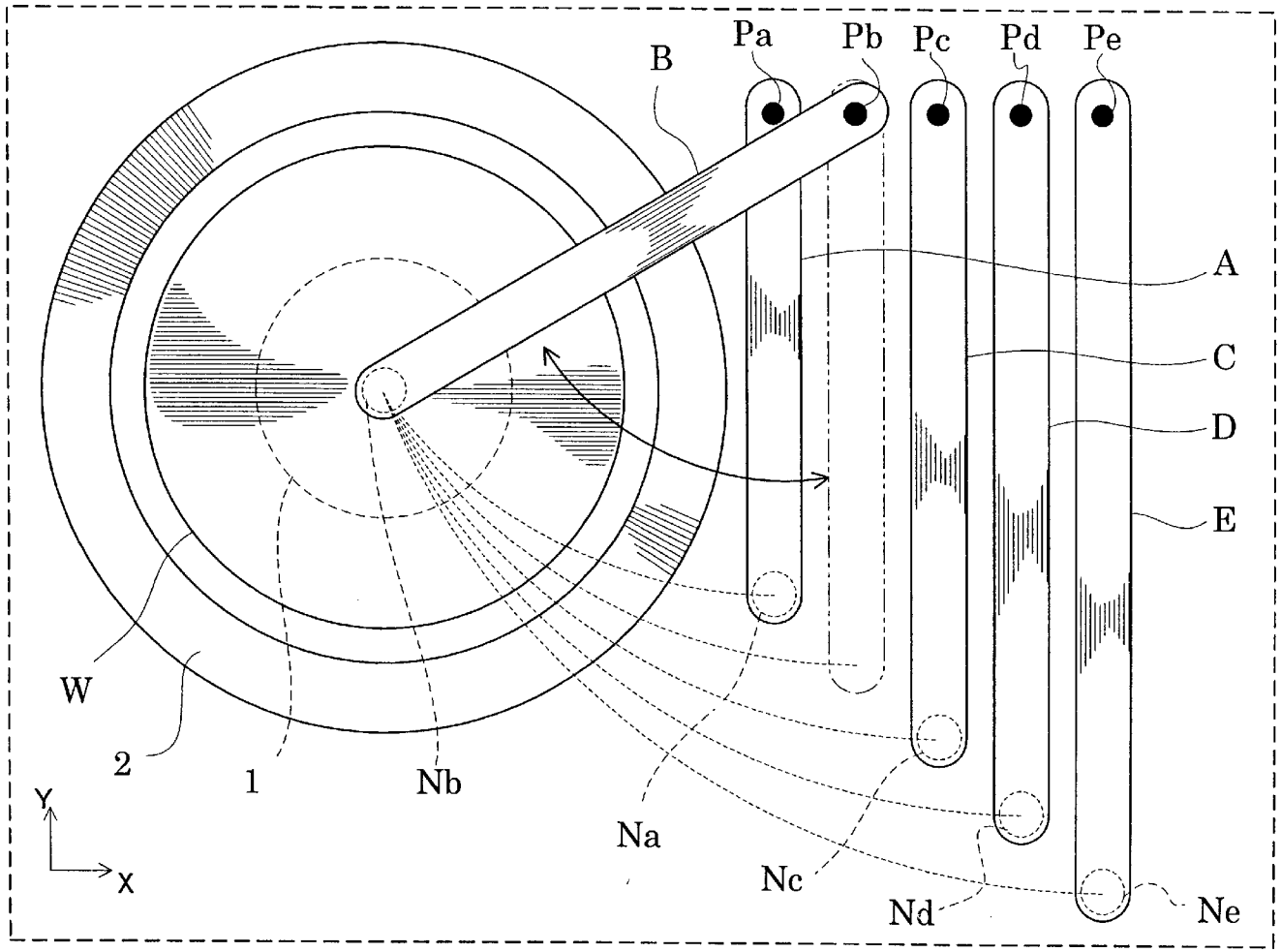
Fig. 1 (PRIOR ART)
FIG. 1 is a schematic plan view of a first type of conventional substrate treating apparatus.
Figure 2:
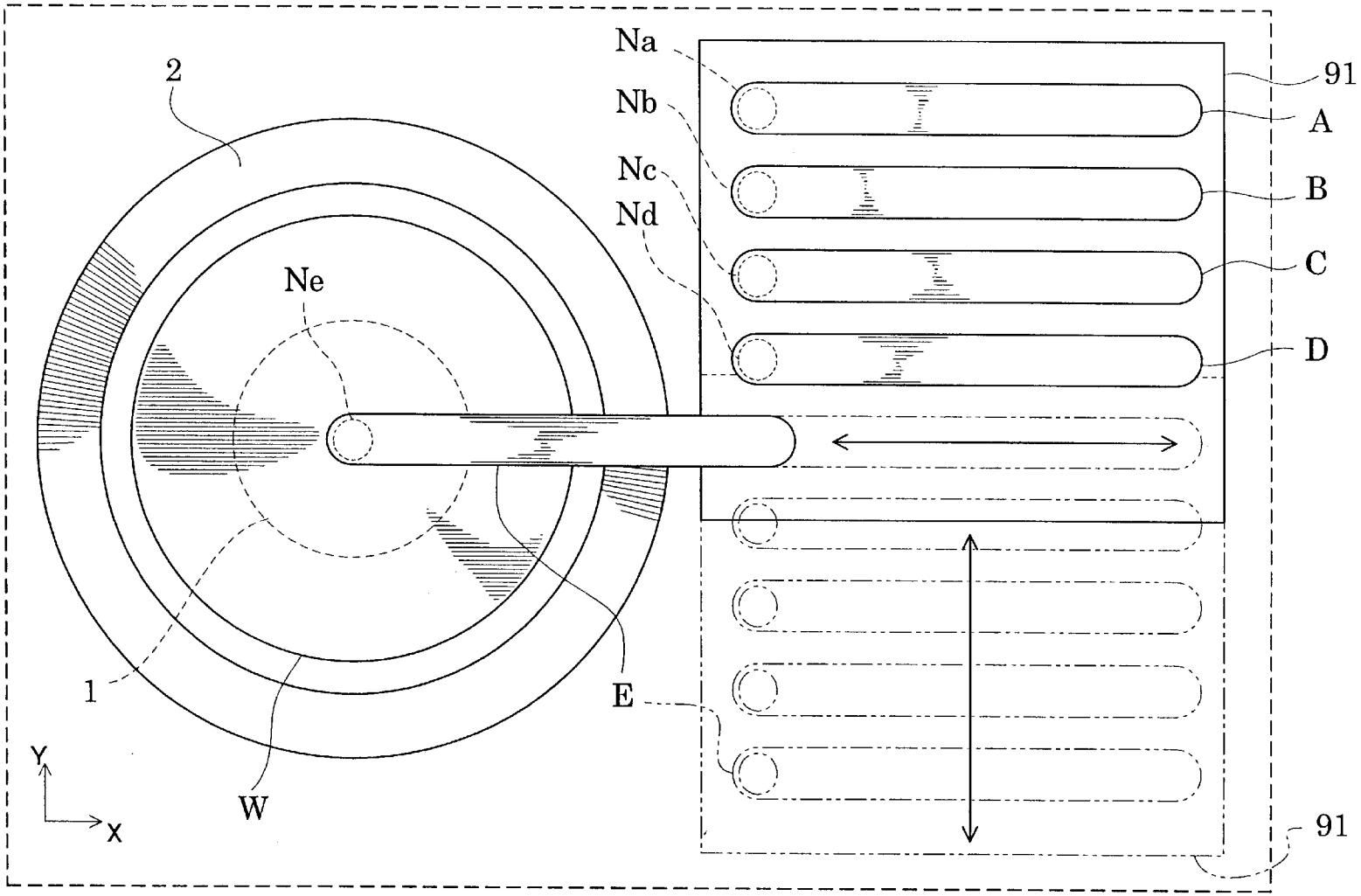
Fig. 2 (PRIOR ART)
FIG. 2 is a schematic plan view of a second type of conventional substrate treating apparatus.
Figure 3:
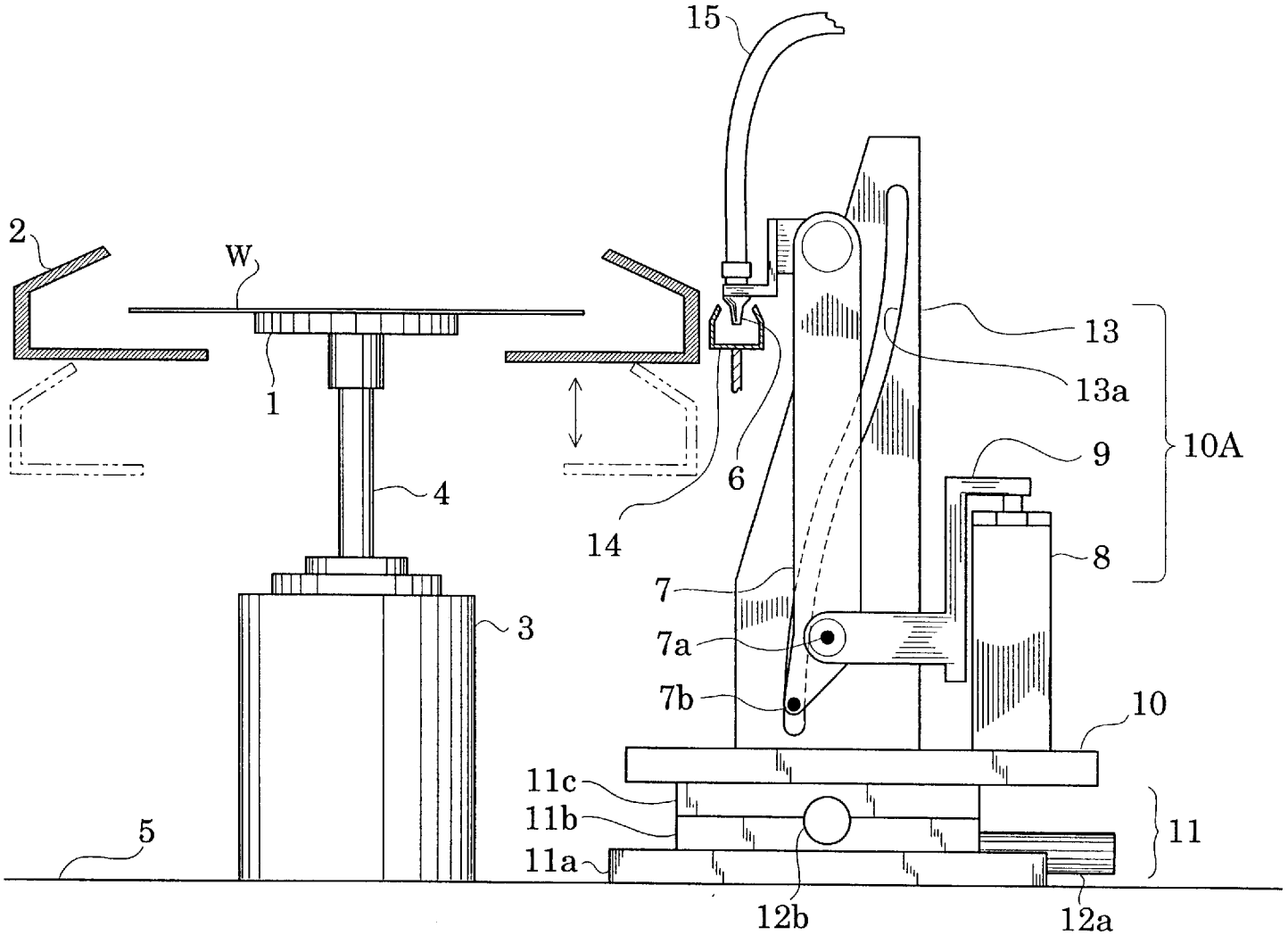
FIG. 3 is a schematic side view of a substrate treating apparatus in a first embodiment of the present invention.
Figure 4:
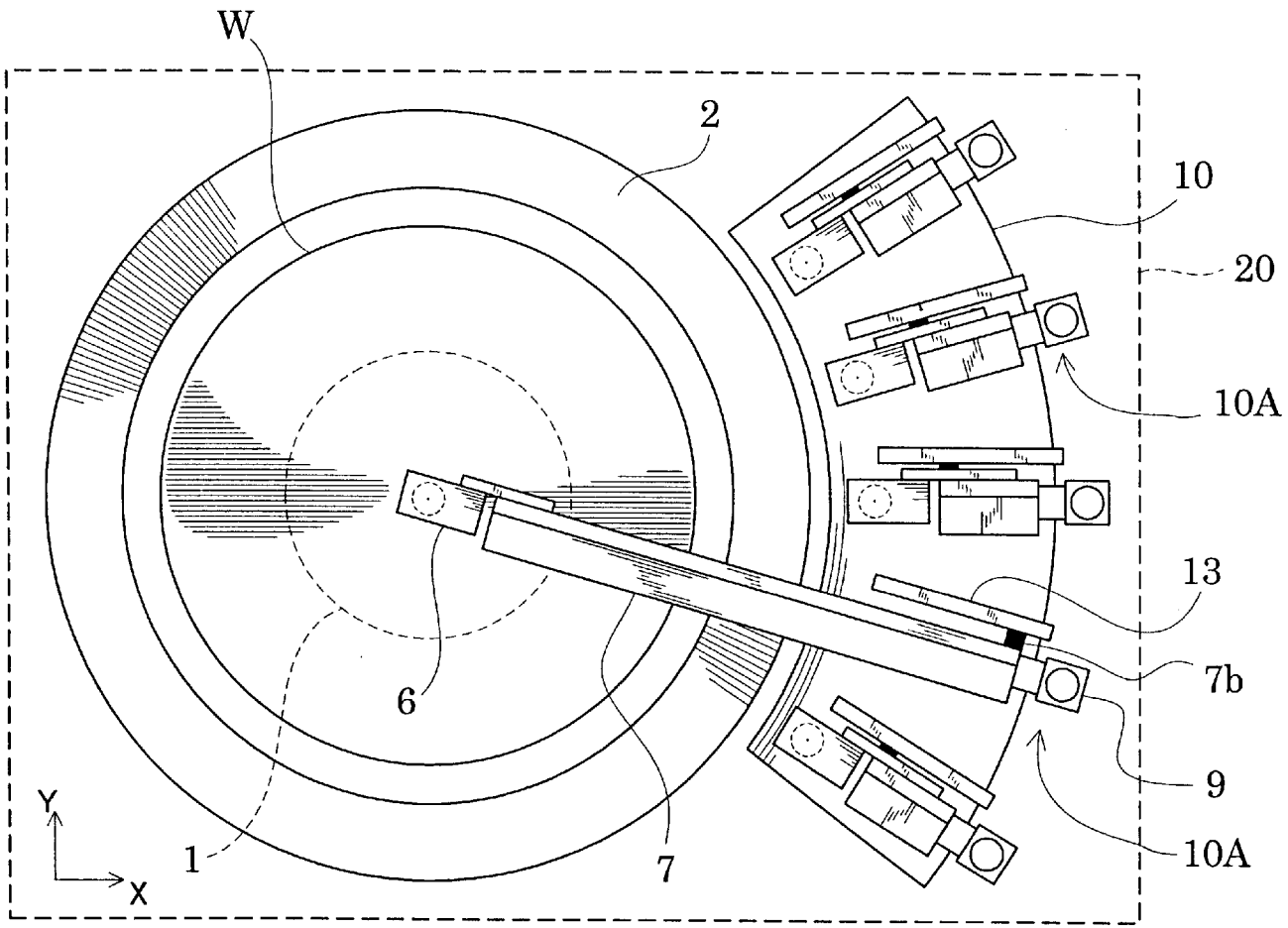
FIG. 4 is a schematic plan view of the substrate treating apparatus in the first embodiment.

FIG. 3 is a schematic side view of a substrate treating apparatus in a first embodiment of the invention. FIG. 4 is a plan view thereof. In this embodiment, the substrate treating apparatus is exemplified by a resist coating apparatus for applying a resist to substrates such as semiconductor wafers. It should be noted, however, that the invention is not limited to the resist coating apparatus, but is applicable also, for example, to a substrate cleaning apparatus for cleaning substrates and to a substrate developing apparatus for developing an exposed pattern.

The resist coating apparatus in this embodiment, broadly, includes a spin treating mechanism for spreading, by centrifugal force, a resist supplied to a wafer W over an entire surface thereof to form a thin, uniform layer on the surface, and a resist supplying mechanism for supplying the resist to the wafer W. Components of the coating apparatus will be described, focusing on the above two mechanisms, with reference to the drawings.

Numeral 20 in FIG. 4 denotes a region in which the above spin treating mechanism and resist supplying mechanism are arranged. This region 20 is divided into a substrate treating region surrounded by a scatter preventive cup 2, and an arm standby region accommodating a sector table 10. The spin treating mechanism is disposed in the substrate treating region, while the resist supplying mechanism is disposed in the arm standby region.

The spin treating mechanism is constructed as follows.

The substrate treating region surrounded by the scatter preventive cup 2 includes a spin chuck 1 for suction-supporting and spinning the wafer W therewith. As shown in FIG. 3, the spin chuck 1 is mounted on an upper end of a rotary shaft 4 rotatable about a vertical axis by an electric motor 3 fixed to a pedestal 5. The scatter preventive cup 2 is provided to prevent superfluous part of the resist from scattering to the ambient when the wafer W with the resist supplied thereto spins at high speed. The scatter preventive cup 2 has a waste liquid collecting structure, not shown, for collecting the superfluous resist scattering from the wafer W as a waste liquid. Further, the scatter preventive cup 2 is vertically movable by a lift mechanism not shown. Although the spin chuck 1 is a vacuum suction type chuck in this embodiment, the present invention is not limited thereto. The spin chuck may have a plurality of pawls arranged for gripping the wafer W at edges thereof.

The resist supplying mechanism is constructed as follows.

In the arm standby region separate from the substrate treating region, the sector table 10 is movable in two orthogonal directions in a horizontal plane by a biaxial drive mechanism 11 fixed to the pedestal 5 as shown in FIG. 3. The sector table 10 has a plurality of, e.g. five, arm drive mechanisms 10A arranged thereon for moving nozzle holder arms 7 between an upstanding posture and a sideways lying posture, respectively. Each holder arm 7 has, attached to a distal end thereof, a treating solution supply nozzle 6 (which may simply be called "nozzle 6" hereinafter) corresponding to a treating device of the present invention. As shown in FIG. 4. the arm drive mechanisms 10A are arranged on the sector table 10 in an arcuate form about the spin center of spin chuck 1. The nozzles 6 attached to the distal ends of the holder arms 7 all point to the spin center. The present invention is not limited to the five sets of holder arms 7 and arm drive mechanisms 10A. The number of sets may be selected as desired.

The biaxial drive mechanism 11 includes a drive system support member 11*a* fixed to the pedestal 5, an X-direction member 11*b* mounted on the drive system support member 11*a* to be movable in X direction, and a Y-direction member 11*c* mounted on the X-direction member 11*b* to be movable in Y direction perpendicular to X direction. The X-direction member 11*b* has an X-axis motor 12*a* for moving the X-direction member 11*b* to a selected position in X direction. Torque of the X-axis motor 12*a* is transmitted to the X-direction member 11*b* through a screw feed mechanism not shown. The Y-direction member 11*c* has a similar construction, with a Y-axis motor 12*b* directed perpendicular to the X-axis motor 12*a*. The sector table 10 is mounted on an upper surface of Y-direction member 11*c* to be movable together. The biaxial drive mechanism 11 corresponds to the position adjusting mechanism of the present invention.

These X-axis motor 12*a* and Y-axis motor 12*b* are rotatable in selected directions on commands from a motor controller not shown. When the X-axis motor 12*a* rotates clockwise, for example, the sector table 10 moves leftward (−X direction) in FIG. 4. When the Y-axis motor 12*b* rotates clockwise, the sector table 10 moves downward (−Y direction) in FIG. 4. In this way, the nozzles 6 described hereinafter may be moved to a selected position in response to movement in X–Y directions of the sector table 10.

As noted above, the sector table 10 supports five arm drive mechanisms 10A for turning the holder arm 7 from the upstanding posture to the lying posture, and vice versa. These arm drive mechanisms 10A are arranged as described hereinbefore. The sector table 10 further supports standby pots 14 arranged thereon each for receiving the nozzle 6 at the distal end of the holder arm 7 standing by in the upstanding posture. This measure is taken to avoid a resist discharge opening of the nozzle 6 being clogged by coagulation of the resist. For this purpose, each standby pot 14 is filled with a chemical atmosphere for preventing coagulation of the resist.

Each arm drive mechanism 10A includes a cam follower 7*b* disposed in a proximal end position of the holder arm 7 displaced from a pivotal axis 7*a* thereof, an arm guide 13 defining a cam groove 13*a* for receiving the cam follower 7*b*, an arm support 9 for supporting the holder arm 7 to be swingable about the pivotal axis 7*a*, and an air cylinder 8 for raising and lowering the arm support 9. The arm support 9 and air cylinder 8 constitute the lift device of the present invention.

Figures 5A, 5B, 5C:
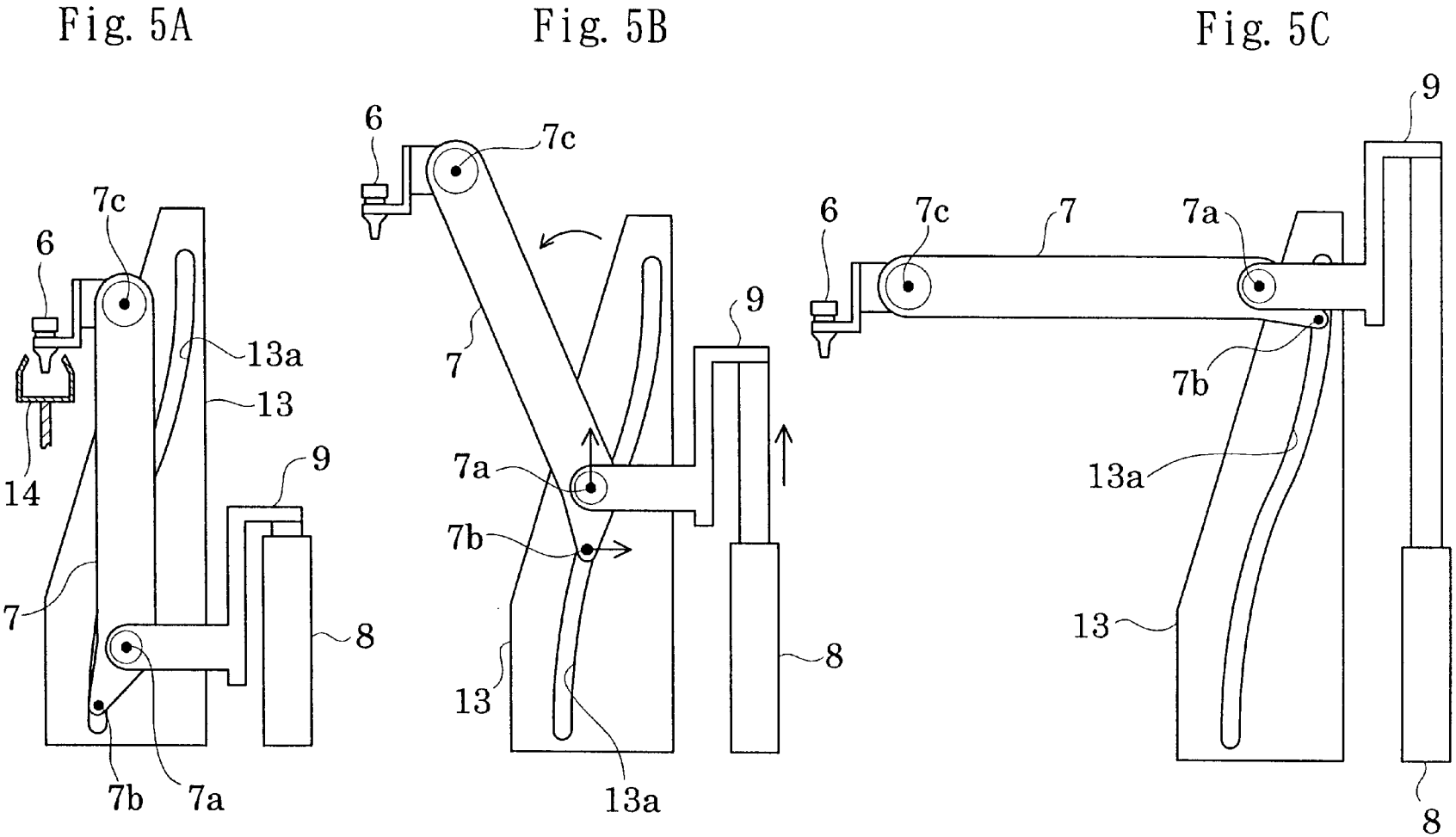
FIGS. 5A, 5B and 5C are explanatory views showing operation of a holder arm driven by an arm drive mechanism.

An operation of each arm drive mechanism 10A for turning the associated holder arm 7 from the upstanding posture for standby to the lying posture for substrate treatment, and constructions of the respective components of the arm drive mechanism 10A, will be described with reference to FIGS. 5A through 5C. FIG. 5A shows the holder arm 7 on standby. In this state, the rod of air cylinder 8 is retracted, and the cam follower 7*b* is in a lower limit position of cam groove 13*a*. Consequently, the holder arm 7 is maintained still in the upstanding posture, with the distal end of holder arm 7 opposite from the cam follower 7*b* across the pivotal axis 7*a* pointing upward. As shown in solid lines in FIG. 3, the holder arm 7 in the upstanding posture lies laterally of the scatter preventive cup 2, and therefore the distal end of holder arm 7 in the upstanding posture is set relatively low.

FIG. 5B illustrates a process of raising the holder arm 7. With air supplied from an air controller not shown to the air cylinder 8, the rod of air cylinder 8 extends to push up the arm support 9. The holder arm 7 moves upward with the arm support 9. The cam groove 13*a* formed in the holder arm guide 13 extends linearly in upper and lower end regions of holder arm guide 13, and includes a mild inclination in an intermediate region thereof which curves away from the substrate treating region. Thus, a force acting in the direction of inclination, i.e. a force acting rightward in FIG. 5B, is applied to the cam follower 7*b* moving along the inclined portion of cam groove 13*a*. As a result, with ascent of the arm support 9, the holder arm 7 swings counterclockwise about the pivotal axis 7*a*.

FIG. 5C shows the lying posture for substrate treatment. The holder arm 7 assumes the lying posture when the rod of air cylinder 8 is extended to place the cam follower 7*b* in an upper limit position of cam groove 13*a*. The upper limit position of cam groove 13*a* is set above the wafer W since, in this position, the nozzle 6 is at a minimum distance to the wafer W. When the nozzle 6 reaches the resist discharge position, the raising operation of air cylinder 8 is stopped. This completes the operation for changing the postures of the holder arm 7. Conversely, the holder arm 7 may be turned from the lying posture to the upstanding posture by retracting the rod of air cylinder 8 to lower the arm support 9.

The present invention is not limited to the shape of the cam groove or the positional relationship between the pivotal axis and cam follower in the foregoing embodiment. For example, the cam groove may include an inclination in the form of a straight line, or may be shaped symmetrical to what is shown in this embodiment. The shape of the cam groove and the positions of the pivotal axis and cam follower may be selected in a way to avoid other components which could interfere with movement of the holder arm. Further, in this embodiment, the upstanding posture of holder arm 7 is vertical, and the lying posture thereof horizontal. The present invention is not limited to such. For example, the holder arm 7 may be in a tilted upstanding posture when in the standby position laterally of the scatter preventive cup 2. In time of treatment, the holder arm 7 may be in an inclined lying posture with the distal end or proximal end thereof raised.

As noted above, each holder arm 7 has a nozzle 6 attached to the distal end thereof for supplying a resist to the wafer W. A relative angle between the holder arm 7 and nozzle 6 may be varied with variations in the posture of holder arm 7. In this embodiment, regardless of variations in the posture of holder arm 7, the nozzle 6 may be maintained in a fixed posture constantly by a nozzle posture control mechanism acting as a treating device posture control device.

Figure 6:
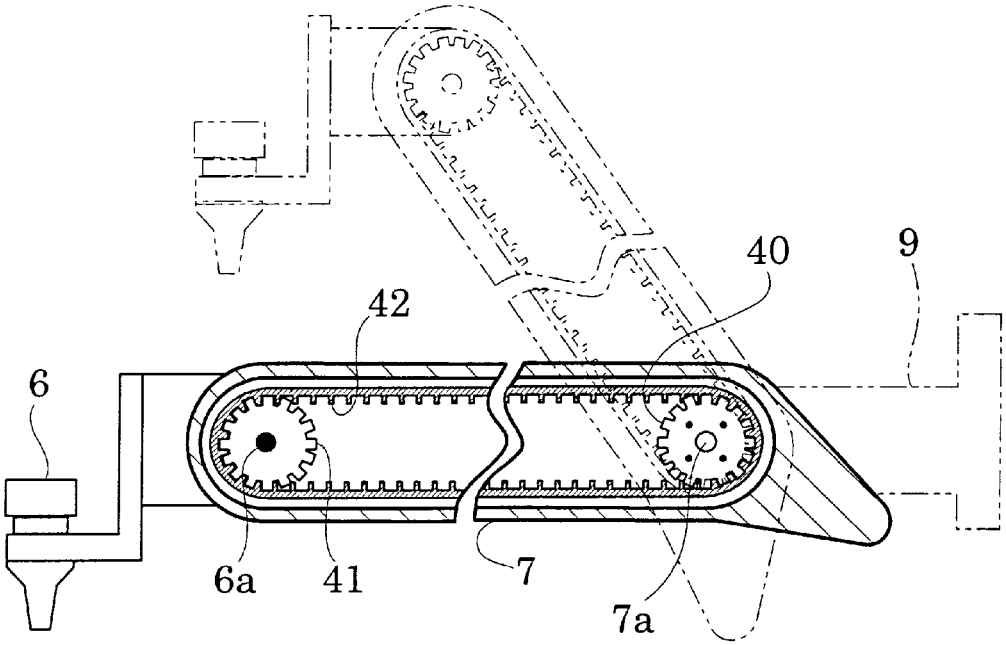
FIG. 6 is a view showing an internal structure of the holder arm.
Figure 7:
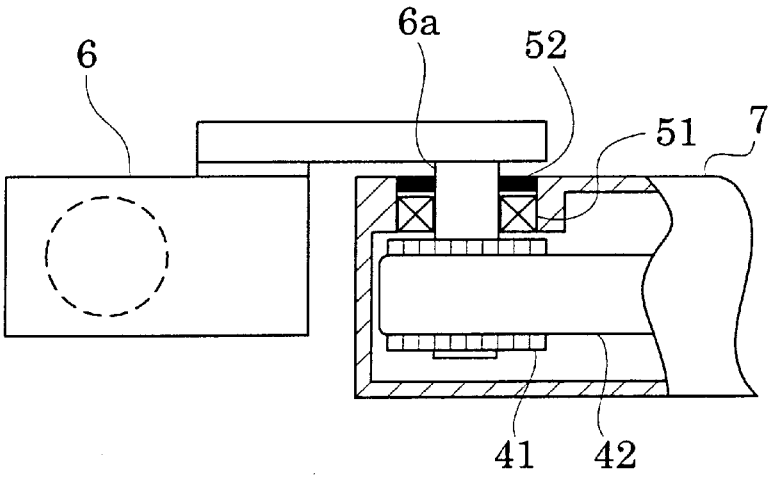
FIG. 7 is an enlarged view of a connection between the holder arm and a treating device.

As shown in FIGS. 6 and 7, the nozzle posture control mechanism is mounted in the holder arm 7. The nozzle 6 is rotatably supported by the holder arm 7 through an axis 6*a* extending through a bearing 51. The bearing 51 and axis 6*a* constitute the rotational support mechanism of the present invention. A first pulley 41 is operatively connected to the axis 6*a*. A second pulley 40 is fixed to the pivotal axis 7*a* in the proximal end region of holder arm 7, which axis 7*a* is fixed to the arm support 9. A toothed endless belt 42 is wound around the first pulley 41 and second pulley 40. A gap between the axis 6*a* coupling the nozzle 6 and first pulley 41 and the holder arm 7 into which the axis 6*a* is inserted is sealed by a magnetic fluid 52 which is a liquid responsive to a magnetic field. The magnetic fluid 52 is sustained by the magnetic field formed in the gap between the axis 6a and holder arm 7 by a magnetic circuit not shown. In this embodiment, the first pulley and second pulley have the same diameter, so that the nozzle 6 is rotatable by the same angle as, and in an opposite direction to, a swing of the holder arm 7. The nozzle 6 has a tip end thereof directed downward when the holder arm 7 takes the upstanding posture or lying posture.

The second pulley 40, which is fixed to the arm support 9, remains stationary at all times regardless of variations in the posture of holder arm 7. The first pulley 41 operatively connected to the nozzle 6 and rotatably mounted on the holder arm 7 is rotatable with movement of the endless belt 42. Thus, when the holder arm 7 swings upward, for example, a relative rotation takes place between the holder arm 7 and second pulley 40. This relative rotation produces a force for causing the endless belt 42 to move around the second pulley 40. However, since the second pulley 40 is fixed, the rotation is transmitted to the first pulley 41. Then, the first pulley 41 rotates in the direction opposite to the swinging direction of holder arm 7. Thus, the tip end of nozzle 6 is constantly directed in a fixed direction regardless of variations in the posture of holder arm 7. In the present invention, the first pulley 41 and second pulley 40 have the same diameter so that the nozzle 6 is constantly directed in a fixed direction, but this is not limitative. The two pulleys may have different diameters, whereby the tip end of nozzle 6 points in different directions when the holder arm 7 is in the upstanding posture and when the holder arm 7 is in the lying posture.

The nozzle 6 has a discharge opening formed at the tip end for discharging the resist, and is connected to a resist supply line 15 which supplies the resist to the nozzle 6 (see FIG. 3). The resist supply line 15 is connected at the other end thereof to a resist supply tank not shown. The resist is supplied from the resist supply tank through the resist supply line 15 to the nozzle 6, and discharged from the discharge opening at the tip end of nozzle 6 toward the wafer W.

A series of processes performed by the resist coating apparatus will be described hereinafter with reference to FIGS. 3 and 4.

The wafer W is unloaded from a substrate storing carrier and transported to the region 20 of the resist coating apparatus by a substrate transport mechanism not shown. Before reaching the region 20, the wafer W undergoes HMDS treatment, baking and so on carried out by way of preliminary treatment of the wafer surface to be coated with the resist.

The resist coating treatment is now started. The wafer W introduced is placed on the spin chuck 1, with the center of wafer W substantially in register with the spin center of spin chuck 1. The spin chuck 1 holds the wafer W in place by suction. With the wafer W suction-supported, the scatter preventive cup 2 is raised by the lift mechanism not shown, to a predetermined height for enclosing the wafer W.

As the scatter preventive cup 2 is raised, the air cylinder 8 begins to push up the arm support 9. With the ascent of arm support 9, the cam follower 7*b* moves upward along the cam groove 13*a* whereby the holder arm 7 begins to tilt from the upstanding posture to the lying posture (see FIG. 5B). At this time, the tip end of nozzle 6 attached to the holder arm 7 is raised from the standby pot 14. When the upward push of the arm support 9 by the air cylinder 8 is completed, the holder arm 7 is in the predetermined lying posture (see FIG. 5C). In the predetermined lying posture of holder arm 7, the nozzle 6 supported by the holder arm 7 lies in the position (i.e. treating position) for discharging the resist to the wafer W.

In the resist discharge position, the resist is supplied from the tip end of nozzle 6 to the wafer W. When the resist has been supplied, the spin chuck 1 is spun at high speed by the electric motor 3. Since the wafer W supported on the spin chuck 1 also spins at high speed, the resist is spread thin and uniform over the wafer W by centrifugal force. The superfluous part of resist scattering from the wafer W is collected by the scatter preventive cup 2. While the wafer W is spinning, the air cylinder 8 lowers the arm support 9 whereby the holder arm 7 switches from the lying posture to the upstanding posture. As a result, the nozzle 6 moves away from the discharge position and rests in the standby pot 14 in the standby position.

When the wafer W stops spinning, the scatter preventive cup 2 is lowered by the lift mechanism not shown. The wafer W coated with the resist is removed from the region 20 by the transport mechanism. The wafer W is then passed to after-treatment such as baking. The above processing may be repeated to treat a predetermined number of wafers. When using one holder arm 7 after another to apply different types of resist, for example, a holder arm 7 used first may be set to the upstanding posture, and a next holder arm 7 to the lying posture. At this time, the timing of posture change should be controlled to avoid an interference between the holder arms.

When a plurality of holder arms 7 are used selectively, the nozzles 6 supported by the respective holder arms 7 in the lying posture for substrate treatment are not necessarily set to the same position because of mechanical errors or the like. It may even be desirable to vary the discharge position deliberately for different types of nozzles. In such a case, the biaxial drive mechanism 11 shown in FIG. 5 should be operated to shift the sector table 10 to adjust the discharge position of nozzle 6 of each holder arm 7. Even if the sector table 10 is shifted, the positional relationship between the standby pot 14 and the nozzle 6 in the standby position (with the holder arm 7 in the upstanding posture) is invariable since the standby pot 14 is supported on the sector table 10. Thus, in the standby position, the nozzle 6 on each holder arm 7 is accurately placed in the standby pot 14.

In the resist coating apparatus described above, a plurality of holder arms 7 are arranged in an arcuate form. Each holder arm 7 stands by in the upstanding posture laterally of the substrate treating region, and is turned from the standby position to the lying posture for substrate treatment by gradually tilting over while moving upward. Thus, the holder arms 7 require a reduced space when on standby, and a reduced height in movement to the upstanding posture or lying posture. Consequently, the apparatus takes up a reduced area for installation.

The first embodiment of the present invention may be modified as follows:

(1) In the first embodiment described above, the air cylinder 8 is provided to act as the lift device for raising and lowering each arm support 9. The air cylinder 8 may be replaced by an electric motor and a screw feed mechanism. Such a construction has an advantage of further reducing the height required for the arm support 9 in turning the holder arm 7 to the lying posture. The arm support 9 may also be stopped at a selected position along the screw feed mechanism to maintain the holder arm 7 in a desired posture for substrate treatment or standby.

Figure 8:
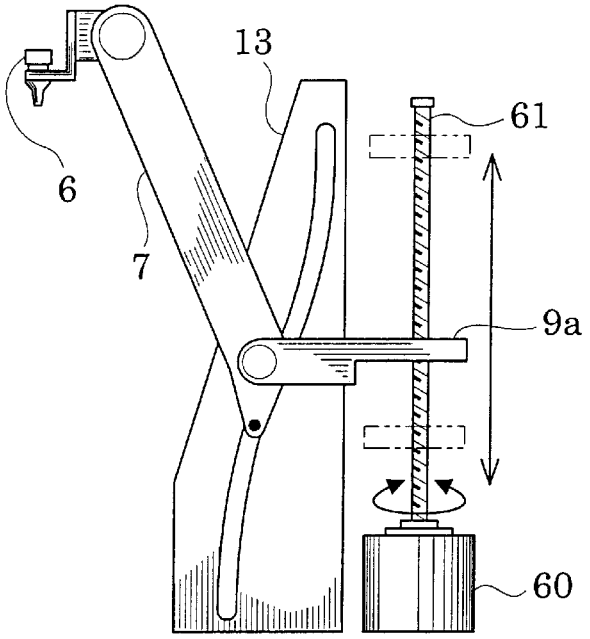
FIG. 8 is a side view of an arm drive mechanism in modification (1)

As shown in FIG. 8, for example, a screw shaft 61 extends through an arm support 9*a*, and is rotatable by an electric motor 60. The electric motor 60 is rotatable under control of a motor controller not shown, to rotate the screw shaft 61 in the same direction as the electric motor 60, thereby to raise or lower the arm support 9*a*. The electric motor 60 may be stopped when the arm support 9*a* reaches a selected position along the screw shaft 61, thereby to maintain the holder arm 7 in a desired posture. Where, in the resist coating apparatus in the described embodiment, the holder arm 7 is not required to stand by in the upstanding posture, the holder arm 7 may be made to stand by in an inclined posture halfway from the lying posture to the upstanding posture. This consumes a reduced time for changing the posture of holder arm 7, to promote treating efficiency.

(2) In the first embodiment, a plurality of holder arms 7 are arranged in the arcuate form about the spin center of spin chuck 1. Instead, the holder arms 7 may be arranged in a row adjacent the scatter preventive cup 2 defining the substrate treating region. In such a construction, the plurality of holder arms 7, preferably, are arranged in a row on a table movable along a single axis. A selected one of the holder arms 7 may be set to a predetermined position by moving this table.

Figure 9:
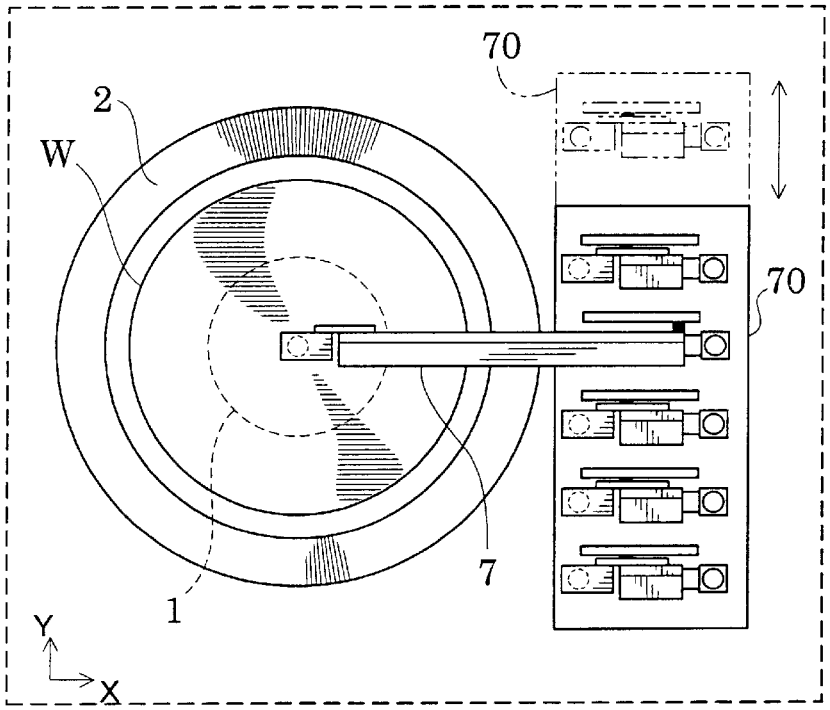
FIG. 9 is a schematic plan view of a substrate treating apparatus in modification (2)

As shown in FIG. 9, for example, a plurality of holder arms 7 are arranged in a row on a rectangular table 70 mounted on a Y-axis drive mechanism not shown to be driven along Y direction. For using a selected one of the holder arms 7 in treatment, the rectangular table 70 is moved by the Y-axis drive mechanism until this holder arm 7 reaches a straight line extending from the spin center of spin chuck 1. Then, the holder arm 7 is turned from the upstanding posture to the lying posture to engage in the treatment. This modified construction has an advantage of reducing the standby space in X direction. The biaxial drive mechanism described in the first embodiment may be used in place of the Y-axis drive mechanism.

Figure 10:
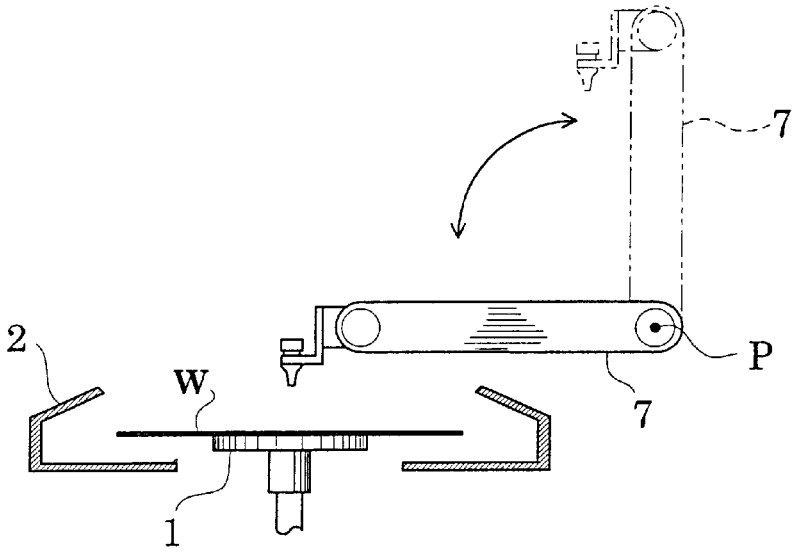
FIG. 10 is an explanatory view showing operation of a holder arm in modification (3)

(3) In the first embodiment, the standby position of each holder arm 7 is set laterally of the substrate treating region. This setting requires the holder arm 7 to be raised in swinging from the upstanding posture to the lying posture. By setting the standby position of holder arm 7 to an elevated level, the holder arm 7 may simply be swung about the proximal end thereof to switch from the upstanding posture to the lying posture. As shown in FIG. 10, for example, a holder arm 7 in a lying posture which is a position for treating the wafer W is swung to an upstanding posture by a driving device not shown, about a pivotal axis P at a proximal end of the support arum 7. This upstanding posture of holder arm 7 corresponds to a standby position. This construction requires only a simplified arm drive mechanism.

Figure 11:
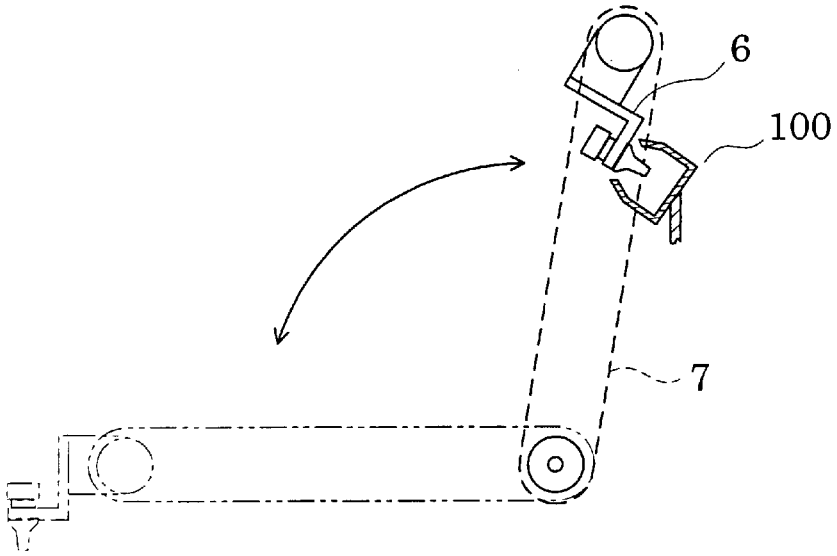
FIG. 11 is a side view showing an operation for controlling posture of a treating device in modification (4)

(4) In the first embodiment, the first pulley and second pulley have the same diameter, so that the nozzle 6 acting as a treating device constantly faces a fixed direction (which is downward in the first embodiment). The diameter of the two pulleys need not necessarily be the same. The first pulley may be of smaller diameter than the second pulley, for example. This construction causes the posture of nozzle 6 to change greatly with variations in the posture of holder arm 7.

Where the first pulley is smaller than the second pulley as shown in FIG. 11, for example, the nozzle 6 is turned rearward when the holder arm 7 is in the upstanding posture, which allows a standby pot 100 to be disposed rearwardly of the holder arm 7. This construction realizes a reduced spacing between the scatter preventive cup 2 and holder arms 7, and a further reduced standby space for the holder arms 7. It is also possible for the first pulley to have a larger diameter than the second pulley. In this case, the posture of nozzle 6 is variable within a reduced range.

Figure 12:
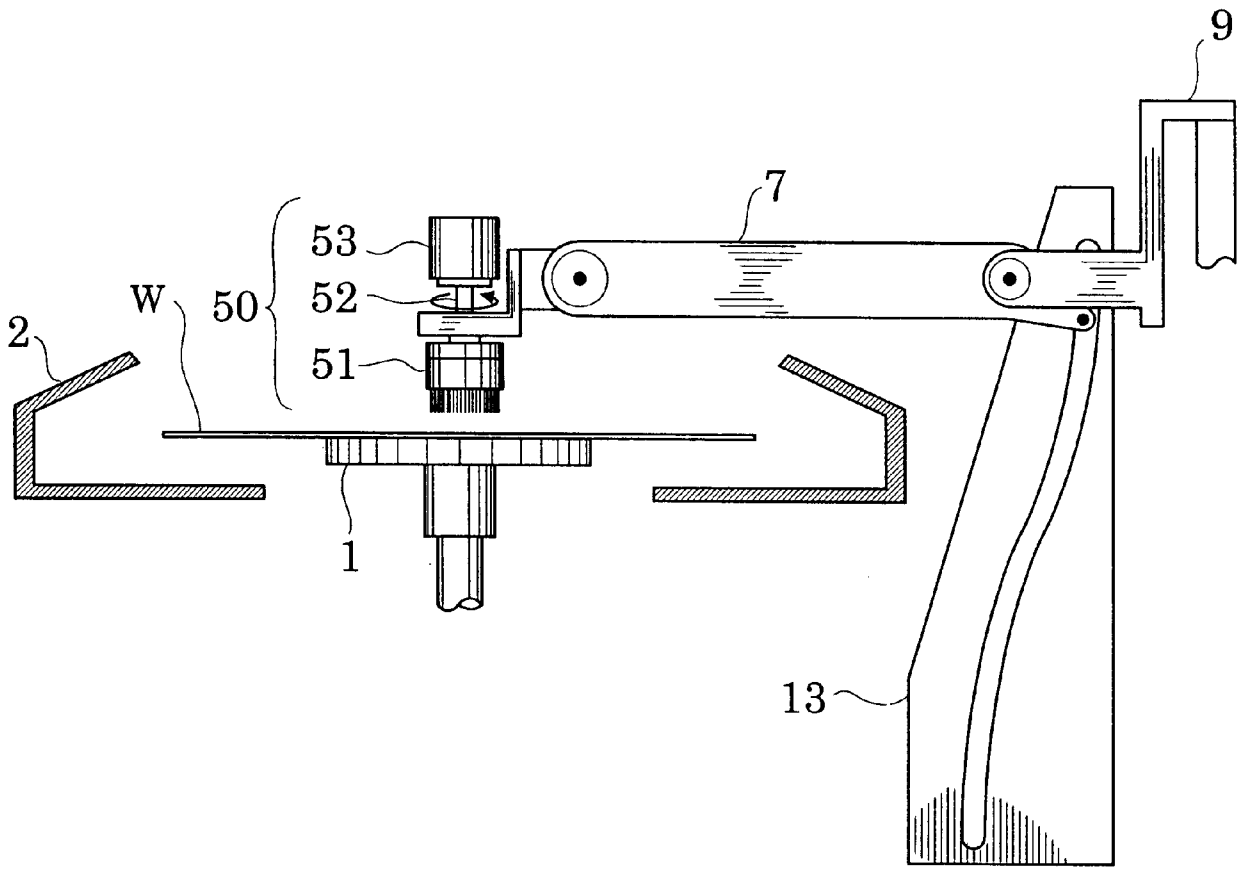
FIG. 12 is a schematic side view of a substrate treating apparatus in modification (5)

(5) While, in the first embodiment, the treating solution supply nozzle 6 is described as an example of treating devices, a cleaning brush may be used instead to clean the wafer W. FIG. 12 shows an outline of a substrate treating apparatus employing cleaning brushes. As seen, a cleaning unit 50 is attached to the distal end of each holder arm 7. The cleaning unit 50 includes a cleaning brush 51 opposed to a wafer W for cleaning its surface, and a drive motor 53 to which the cleaning brush 51 is connected to be rotatable through a rotary shaft 52. The cleaning brush 51 rotated by the drive motor 53 is placed in contact with the wafer W to clean the latter. With the cleaning brush attached to the distal end of each holder arm 7, the substrate treating apparatus requires a reduced area for installation.

(6) While the first embodiment provides a plurality of holder arms, the present invention is applicable also to a substrate treating apparatus having only one holder arm.

(7) The holder arms 7 are not swingable horizontally in the first embodiment, but they may be adapted swingable horizontally. For example, the sector table 10 shown in FIGS. 3 and 4 may support a plurality of turntables rotatable in a horizontal plane, with the arm drive mechanism 10A of each holder arm 7 mounted on each turntable. The air cylinder 8 and holder arm guide 13 are arranged such that the rotational axis of each turntable and the pivotal axis 7*a* of each arm drive mechanism 10A are aligned vertically. According to this example, the nozzle 6 supported by the holder arm 7 is movable along an arcuate track outwardly from the center of wafer W.

Figure 13:
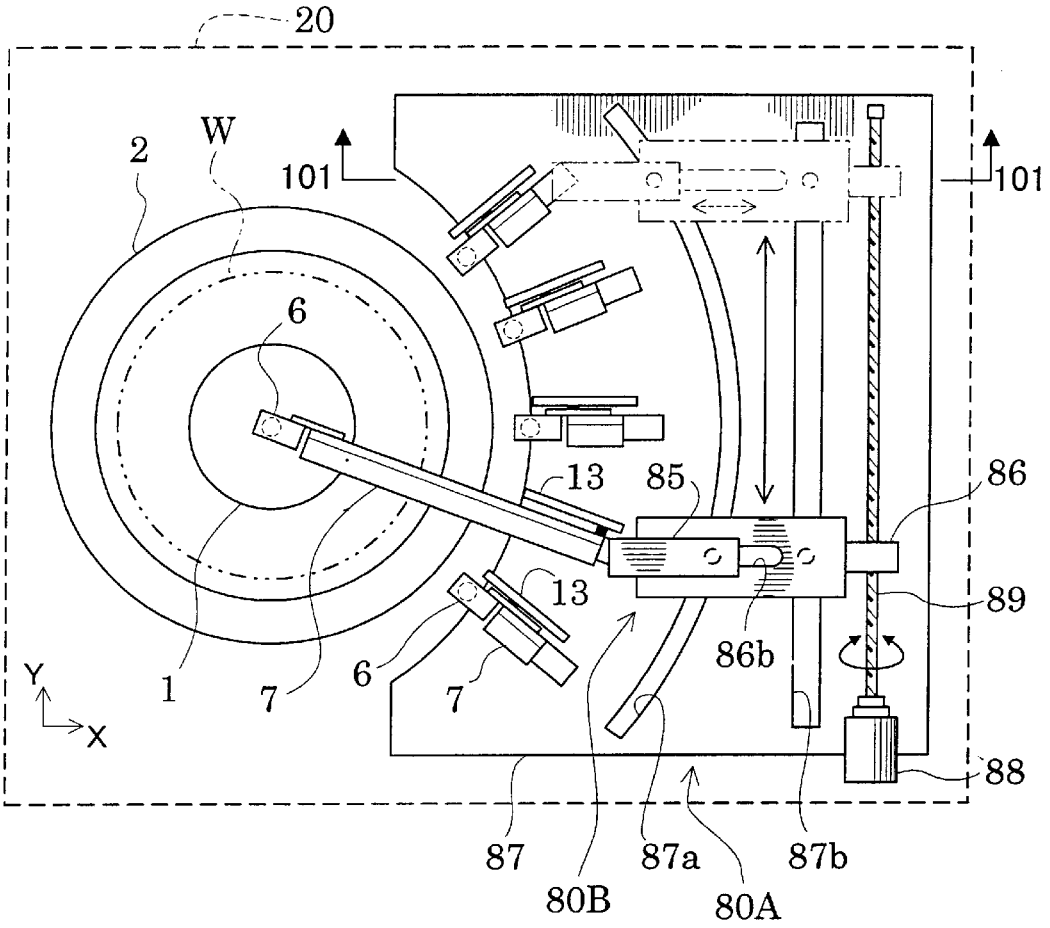
FIG. 13 is a schematic plan view of a substrate treating apparatus in modification (8)
Figure 14:
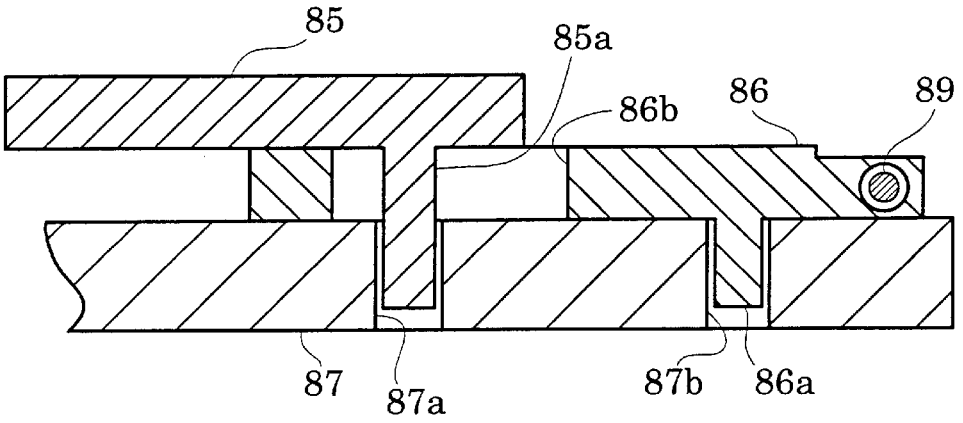
FIG. 14 is a sectional view of a principal portion of a selecting mechanism.
Figure 15:
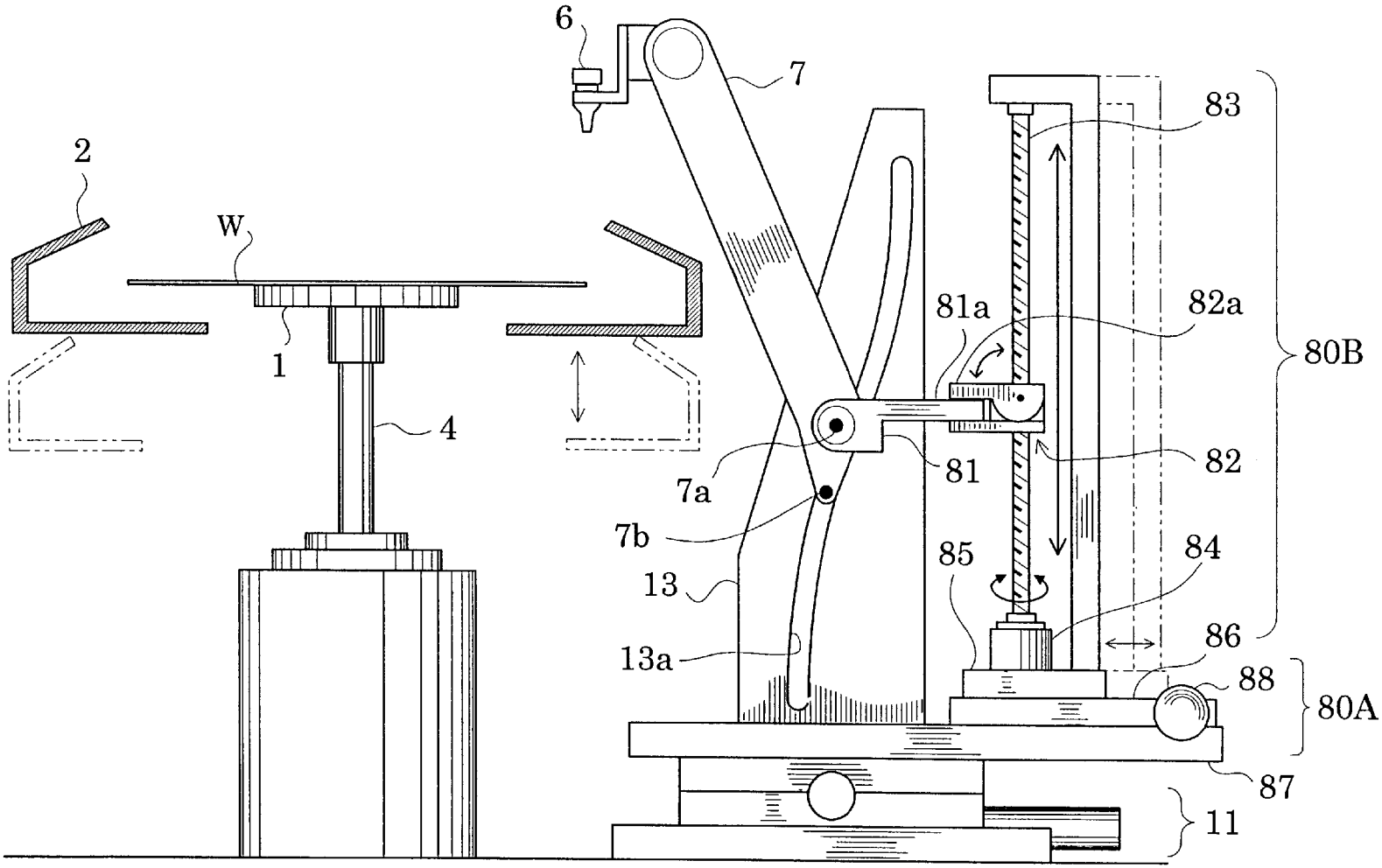
FIG. 15 is a schematic side view of the substrate treating apparatus in modification (8).

(8) In the first embodiment, the plurality of holder arms 7 have arm drive mechanisms 10A individually provided therefor. However, it is possible to select a desired one of the holder arms with a selecting device, and change the posture of the selected holder arm with a single arm drive device. This modification will be described hereinafter with reference to FIGS. 13 through 15. FIG. 13 is a schematic plan view of a substrate treating apparatus having a selecting mechanism acting as the selecting device. FIG. 14 is a section taken on line 101—101 of FIG. 13. FIG. 15 is a side view of the apparatus.

A guide member 87 is mounted on the biaxial drive mechanism 11. The guide member 87 has plural sets of holder arms 7 and holder arm guides 13 arranged in an arcuate form adjacent the scatter preventive cup 2. The constructions of holder arms 7 and holder arm guides 13 are similar to those in the embodiment shown in FIG. 5, and will not be described again. The guide member 87 further includes, arranged thereon, a selecting mechanism 80A for selecting one of the holder arms 7, and a single arm drive mechanism 80B for driving the holder arm 7 selected by the selecting mechanism 80A.

The construction of selecting mechanism 80A will be described first.

The guide member 87 defines an arcuate guide groove 87*a* extending along the arcuate arrangement of holder arms 7. A straight guide groove 87*b* extends in the Y direction alongside the guide groove 87*a*. As shown in FIG. 14, a first slide member 86 has a projection 86*a* formed on a lower surface thereof and fitted in the straight guide groove 87*b*. Thus, the first slide member 86 is guided by the guide groove 87*b* along the Y direction. Further, a screw shaft 89 rotatable by an electric motor 88 extends along the guide groove 87*b*. The first slide member 86 is mesh with the screw shaft 89 to be driven by the latter. The first slide member 86 defines a guide groove 86*b* extending in X direction. A second slide member 85 is mounted on the first slide member 86. As shown in FIG. 14, the second slide member 85 has a projection 85*a* formed on a lower surface thereof, which extends through the guide groove 86*b* of first slide member 86 into the arcuate guide groove 87*a* of guide member 87. With this construction, when the first slide member 86 moves in Y direction, a force is applied in X direction from the arcuate guide groove 87*a* to the projection 85*a* of second slide member 85, whereby the second slide member 85 is moved in X direction along the guide groove 86*b*.

Next, the construction of the single arm drive mechanism 80B will be described.

As shown in FIG. 15, the arm drive mechanism 80B is mounted on the second slide member 85. The arm drive mechanism 80B raises and lowers a gripping mechanism 82 by means of a screw feed mechanism including an electric motor 84 and a screw shaft 83. The gripping mechanism 82 has a gripper 82*a* openable and closable by a rotary actuator, not shown, for gripping a distal end 81*a* of an arm support 81 fixed to the pivotal axis 7*a* of holder arm 7.

The selecting mechanism 80A and arm drive mechanism 80B having the above constructions are operable as follows.

Initially, the gripping mechanism 82 is in a lower limit position with the gripper 82*a* opened. In this state, the electric motor 88 is started to move the first slide member 86 in Y direction along the guide groove 87*b* to a position behind a selected one of holder arms 7. With the movement of the first slide member 86, the second slide member 85 is moved in X direction along the guide groove 86*b*. As a result, the gripping mechanism 82 mounted on the second slide member 85 moves to a gripping position to grip the selected holder arm 7. The gripper 82*a* of gripping mechanism 82 in the gripping position is closed, whereby the gripping mechanism 82 grips the arm support 81 of the selected holder arm 7. Next, the electric motor 84 is operated to raise the gripping mechanism 82. As the gripping mechanism 82 is raised, the selected holder arm 7 is swung from the upstanding posture to the lying posture for substrate treatment. After the treatment, the holder arm 7 returns to the standby position by a sequence reversed from the above operation.

<Second Embodiment>

Figure 16:
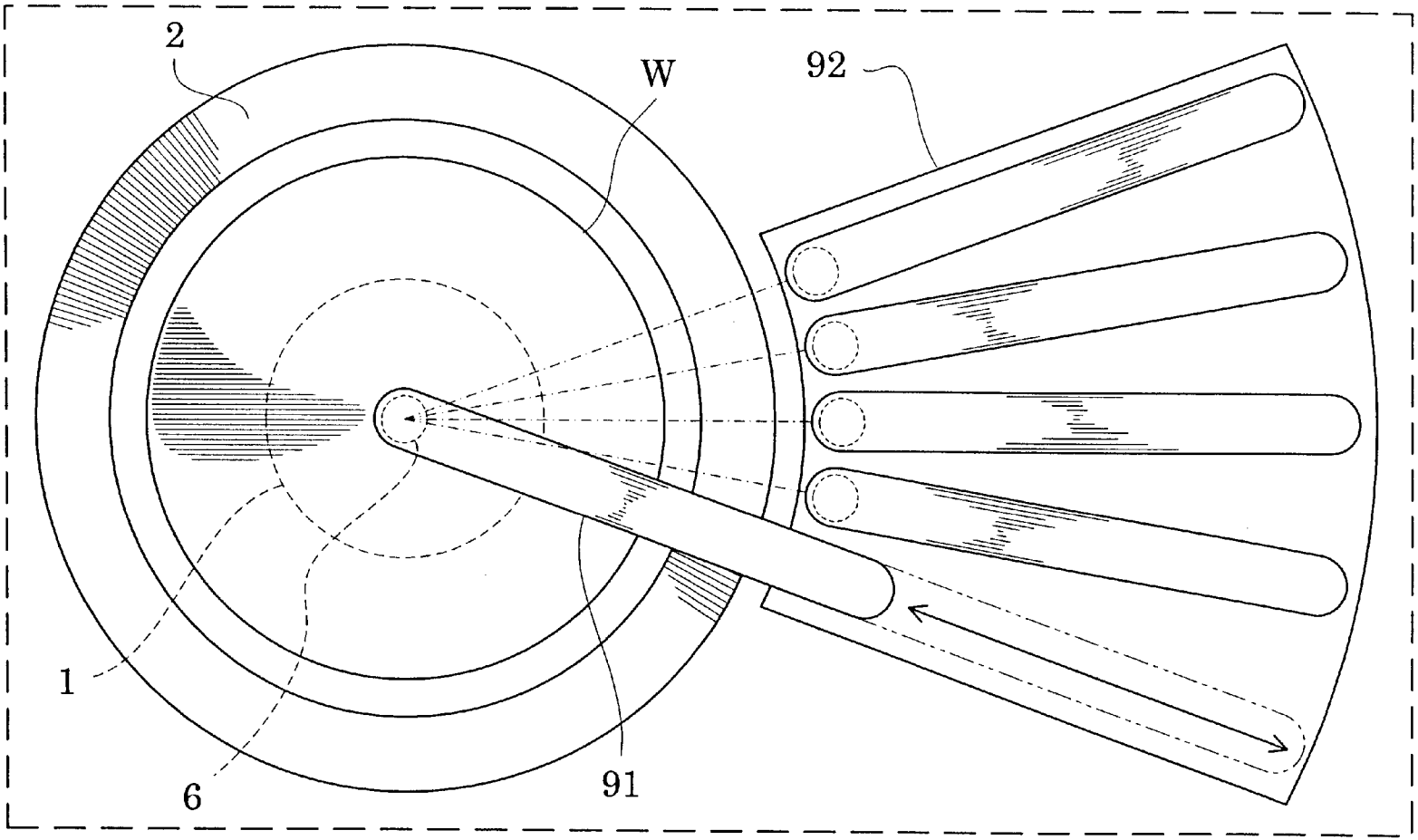
FIG. 16 is a schematic plan view of a substrate treating apparatus in a second embodiment of the invention.
Figure 17:
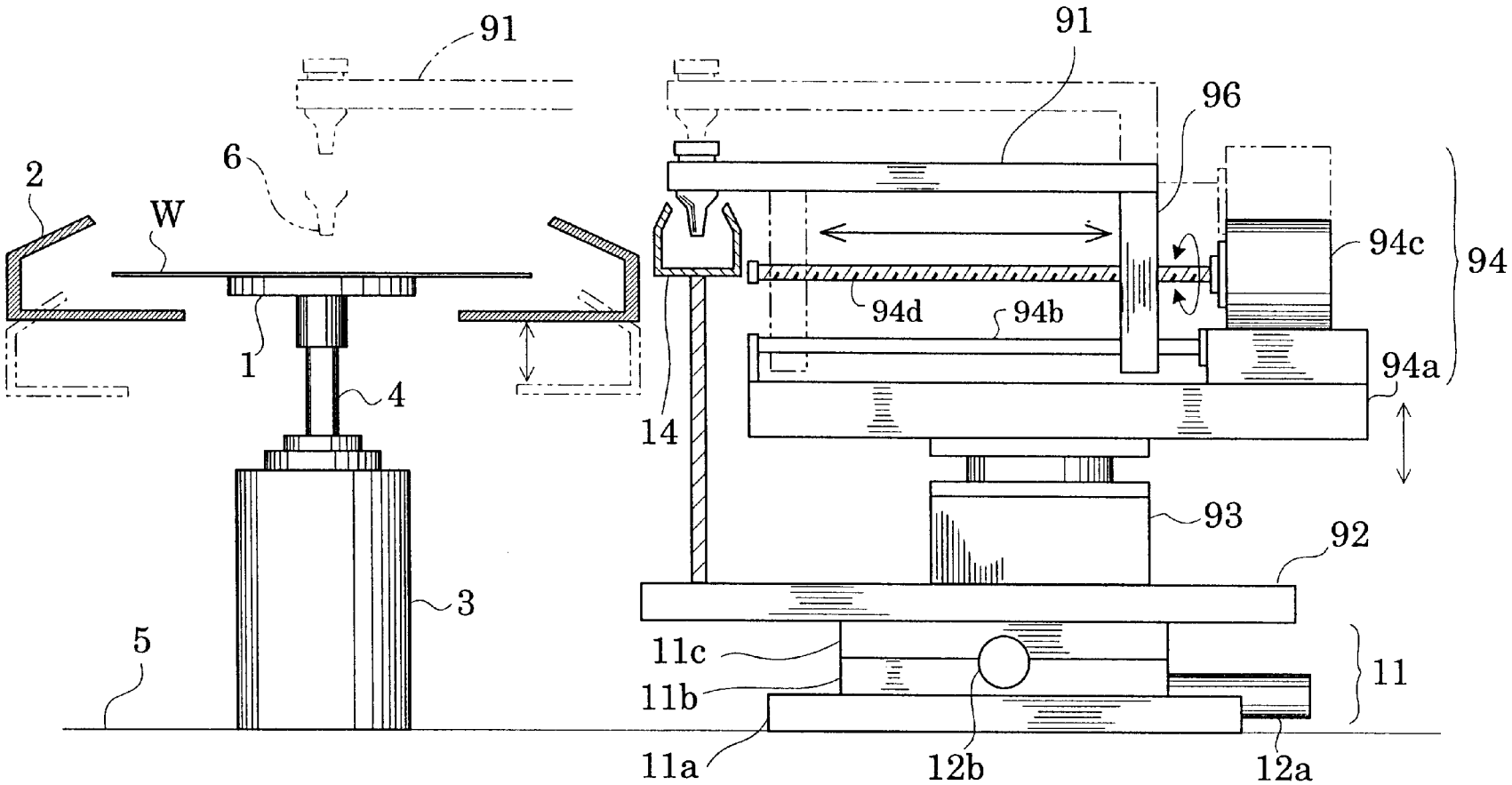
FIG. 17 is a schematic side view of the substrate treating apparatus in the second embodiment.

FIG. 16 is a schematic plan view of a principal portion of a substrate treating apparatus in a second embodiment of the present invention. FIG. 17 is a side view thereof. This embodiment will be described in relation to a resist coating apparatus for applying a resist to wafers, which is one example of substrate treating apparatus.

The resist coating apparatus in this embodiment, broadly, includes a spin treating mechanism for spreading, by centrifugal force, a resist supplied to a wafer W over an entire surface thereof to form a thin, uniform layer on the surface, and a resist supplying mechanism for supplying the resist to the wafer W. The spin treating mechanism is the same as in the first embodiment, and will not be described again. The resist supplying mechanism will be described hereinafter with reference to the drawings.

The arm standby region separate from the substrate treating region includes a table 92 movable in two orthogonal directions in a horizontal plane by a biaxial drive mechanism 11 fixed to the pedestal 5 as shown in FIG. 17. The table 92 has, fixed thereto, air cylinders 93 for raising and lowering linear arm drive mechanisms 94, and standby pots 14 similar to those in the first embodiment. Each linear arm drive mechanism 94 corresponds to an arm drive device of the present invention, and is operable to drive a holder arm 91 linearly back and forth. The holder arm 91 has, attached to a distal end thereof, a treating solution supply nozzle 6 (which may simply be called "nozzle 6" hereinafter) corresponding to a treating device of the present invention. The holder arm 91 is connected at a proximal end thereof to the linear arm drive mechanism 94, and carries the nozzle 6 at the distal end. The holder arms 91 are arranged along with the linear arm drive mechanisms 94 on the table 92 as follows. As shown in FIG. 16, five sets of holder arms 91 and linear arm drive mechanisms 94 are arranged radially on the table 92, with the distal ends of holder arms 91 pointing to the spin center of spin chuck 1, i.e. the treating position. The present invention is not limited to the five sets of holder arms 91 and linear arm drive mechanisms 94. The number of sets may be selected as desired.

The construction and operation of the biaxial drive mechanism 11 are similar to those in the first embodiment. In the second embodiment, the table 92 is mounted on the biaxial drive mechanism 11 to be movable together. Consequently, each nozzle 6 movable with movement in X and Y directions of table 92, as described hereinafter, may be moved to a selected position by controlling the table 92. In moving the nozzle 6 by controlling the table 92, the linear arm drive mechanism 94 is also operated to move the holder arm 91, which will be described hereinafter, straight to set the nozzle 6 to the treating position opposed to the wafer W. When, for example, the nozzle 6 is slightly displaced from a desired position, the table 92 is moved to effect a fine adjustment of the nozzle position.

The linear arm drive mechanism 94 includes an electric motor 94*c* for rotating a screw shaft 94*d* meshed with an arm support 96 provided at a proximal end of holder arm 91, and a guide member 94*b* extending through the arm support 96 for allowing the holder arm 91 to move straight in a fixed posture. When, for example, the electric motor 94*c* is operated by a motor controller, not shown, to rotate leftward, its torque is transmitted to the arm support 96 through the screw shaft 94*d*. As a result, the arm support 96 moves along the guide member 94*b* toward the spin chuck 1. Thus, the holder arm 91 is movable in any desired direction by changing the direction of rotation of electric motor 94*c*.

A series of processes performed by the resist coating apparatus in the second embodiment will be described hereinafter.

As described in the first embodiment, a wafer W is placed on the spin chuck 1, with the center of wafer W substantially in register with the spin center of spin chuck 1. The spin chuck 1 holds the wafer W in place by suction. With the wafer W suction-supported, the scatter preventive cup 2 is raised by the lift mechanism not shown, to a predetermined height for enclosing the wafer W.

After the scatter preventive cup 2 is raised, a selected one of the air cylinders 93 is operated to raise the associated linear arm drive mechanism 94. With the ascent of the drive mechanism 94, the nozzle 6 is raised from the standby pot 14. When the linear arm drive mechanism 94 has been raised by the air cylinder 93, the linear arm drive mechanism 94 operates the electric motor 94*c* to rotate the screw shaft 94*d*. As a result, the holder arm 91 advances straight with the arm support 96 meshed with the screw shaft 94*d*. When the nozzle 6 at the distal end of holder arm 91 is set above the position for discharging the resist to the wafer W, the linear arm drive mechanism 94 stops the rotation of electric motor 94*c*. Subsequently, the air cylinder 93 is contracted to lower the holder arm 91, whereby the nozzle 6 is lowered to the position (treating position) for discharging the resist to the wafer W.

In the treating position, the resist is supplied through the discharge opening of nozzle 6 to the wafer W. When the resist has been supplied, the wafer W is spun at high speed, as in the first embodiment, to spread the resist uniformly over the wafer W. While the wafer W is spinning, the air cylinder 93 raises the linear arm drive mechanism 94. Subsequently, the electric motor 94*c* is rotated to draw the arm support 96 back toward the electric motor 94*c*, and the air cylinder 93 is operated to lower the linear arm drive mechanism 94 to bring the holder arm 91 to the standby position. As a result, the nozzle 6 is placed in the standby pot 14 in the standby position.

After the resist application, the wafer W is removed and passed to a next treating process by the transport mechanism as in the first embodiment. The above processing may be repeated to treat a predetermined number of wafers. When using one holder arm 91 after another to apply different types of resist, a holder arm 91 used first may be retracted to the standby position before moving a next holder arm 91.

In the above resist coating apparatus, a plurality of holder arms 91 are arranged radially, and a selected holder arm 91 is moved straight to the predetermined position for treating the wafer W. Thus, an increased number of holder arms 91 may be arranged in the same area as in the conventional substrate treating apparatus where a plurality of holder arms are arranged, which results in a space saving. Further, since there is no need to provide plural types of holder arms having different sizes or lengths, the components may be shared for use. The apparatus has a simplified construction, with only the same type of drive mechanism provided for each holder arm.

The second embodiment of the present invention may be modified as follows:

(1) In the second embodiment described above, all holder arms 91 are arranged to point toward the spin center of spin chuck 1. Where, for example, a plurality of positions are provided for treating the wafer W (positions from which treating solutions are supplied to the wafer W), the holder arms 91 may be arranged to point toward the respective treating positions. Then, even where a plurality of positions are provided for treating the wafer W, the holder arms 91 may advance straight to the respective treating positions to carry out a predetermined treatment of the wafer W.

(2) In the second embodiment, the electric motor 94*c* of each linear arm drive mechanism 94 is disposed adjacent the proximal end of holder arm 91. For example, the electric motor 94*c* may be disposed adjacent the distal end of holder arm 91. With such a construction, effective use is made of a space below the scatter preventive cup 2, and a reduced area is required rearwardly of the holder arms on standby, thereby saving overall space.

Figure 18A:
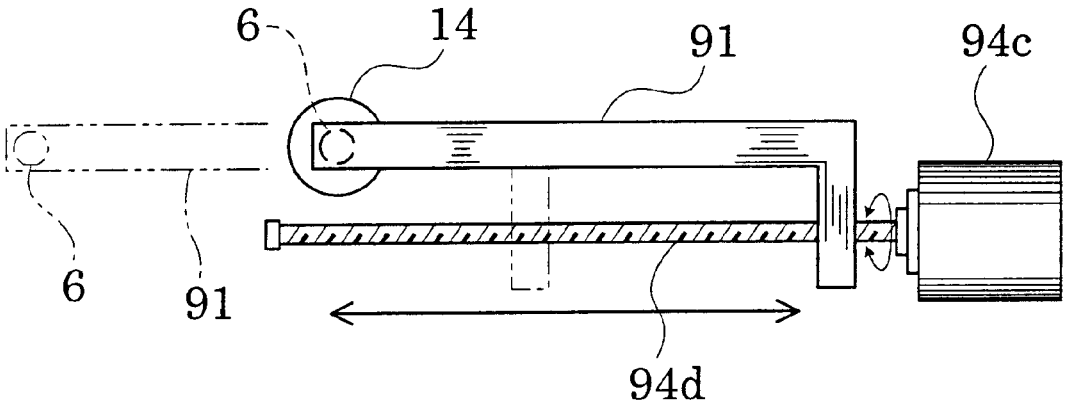
FIGS. 18A and 18B are explanatory views showing operation of an arm drive mechanism in the second embodiment.
Figure 18B:
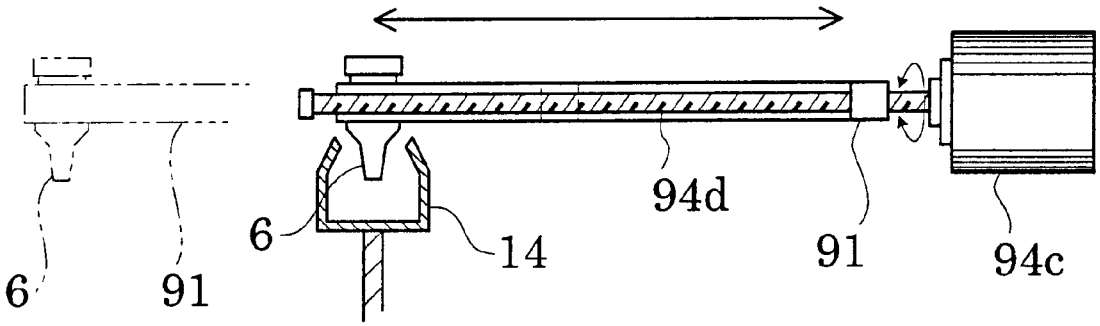

(3) In the above embodiment, the holder arm 91 and linear arm drive mechanism 94 in each set are arranged vertically. However, the holder arm 91 and linear arm drive mechanism 94 may be arranged side by side in a horizontal plane. As shown in the plan view of FIG. 18A and side view of FIG. 18B, for example, the holder arm 91 may be mounted to extend parallel to the screw shaft 94*d*. With the screw shaft 94*d* and holder arm 91 arranged side by side, the standby pot 14 may be shifted rightward or leftward, allowing the holder arm to have a reduced length. Thus, the standby space may be further reduced in the longitudinal direction of holder arms 91.

(4) In the second embodiment, each linear arm drive mechanism 94 is raised to withdraw the nozzle 6 upward from the standby pot 14, and then operated to advance the holder arm 91 straight to carry out the predetermined treatment. Instead of raising and lowering the linear arm drive mechanism 94, a lift mechanism may be provided for lowering the standby pot 14 to draw the nozzle 6 out of the standby pot 14. This construction requires only a simple lift mechanism capable of raising and lowering the standby pot 14.

The present invention may be embodied in other specific forms without departing from the spirit or essential attributes thereof and, accordingly, reference should be made to the appended claims, rather than to the foregoing specification, as indicating the scope of the invention.

What is claimed is:

1. A substrate treating apparatus for treating a substrate in a predetermined substrate treating region, comprising:

spin support means for holding and rotating a substrate in a horizontal posture;

a holder arm having a treating device attached to a distal end thereof for treating said substrate; and an arm drive mechanism for maintaining said holder arm in a substantially vertical posture at a standby position adjacent to said substrate treating region when said treating device is not in use for substrate treatment, and for turning said holder arm to a substantially horizontal posture to move said treating device to a position for treating said substrate;

wherein said arm drive mechanism is operable to maintain said holder arm in said substantially vertical posture in said standby position laterally offset from but adjacent to said substrate treating region when said treating device is not in use, and for turning said holder arm to said substantially horizontal posture, by raising said holder arm from said standby position and tilting said holder arm toward said substrate treating region, to move said treating device to the position for treating said substrate.

2. A substrate treating apparatus as defined in claim 1, wherein said arm drive mechanism comprises a lift mechanism engaged with a proximal end portion of said holder arm for raising and lowering said holder arm while allowing a swing of said holder arm, an arm guide member disposed adjacent said holder arm in said standby position and defining a cam groove extending substantially vertically for guiding said holder arm in turning from said substantially vertical posture to said substantially horizontal posture, and a cam follower attached to a position adjacent a proximal end and displaced from a pivotal axis of said holder arm for moving along said cam groove.

3. A substrate treating apparatus as defined in claim 2, wherein said lift mechanism comprises an air cylinder.

4. A substrate treating apparatus as defined in claim 2, wherein said lift mechanism comprises a screw feed mechanism including an electric motor and a screw shaft.

5. A substrate treating apparatus as defined in claim 1, further comprising treating device posture control means for varying a mounting angle of said treating device with respect to said holder arm with variations in posture of said holder arm.

6. A substrate treating apparatus as defined in claim 5, wherein said treating device posture control means comprises a rotational support mechanism for rotatably connecting said treating device to said holder arm, a first pulley operatively connected to said rotational support mechanism, a second pulley fixed to a pivotal axis adjacent a proximal end of said holder arm, and an endless belt wound around said first pulley and said second pulley.

7. A substrate treating apparatus as defined in claim 6, wherein said first pulley and said second pulley are equal in diameter.

8. A substrate treating apparatus as defined in claim 5, wherein said rotational support mechanism is sealed with a magnetic fluid.

9. A substrate treating apparatus as defined in claim 1, wherein said treating device comprises a treating solution supplying nozzle for supplying a treating solution to said substrate in said substrate treating region.

10. A substrate treating apparatus as defined in claim 1, wherein said treating device comprises a cleaning brush for cleaning said substrate in said substrate treating region.

11. A substrate treating apparatus as defined in claim 1, further comprising a standby pot for receiving said treating tool attached to said distal end of said holder arm when said holder arm is on standby in said substantially upstanding posture in said standby position separate from said substrate treating region.

12. A substrate treating apparatus as defined in claim 1, further comprising a plurality of holder arms arranged in an arcuate form around said substrate treating region.

13. A substrate treating apparatus as defined in claim 12, further comprising a position adjusting mechanism for supporting said plurality of holder arms, and positionally adjusting said treating device supported by each holder arm when said treating device is in said position for treating said substrate.

14. A substrate treating apparatus as defined in claim 12, further comprising selecting means for selecting a desired one of said holder arms, said arm drive means being operable for turning said desired one of said holder arms selected by said selecting means from said substantially vertical posture for non-treatment to said substantially horizontal posture for treatment.

15. A substrate treating apparatus as defined in claim 1, further comprising a plurality of holder arms arranged in a row adjacent said substrate treating region.

16. A substrate treating apparatus for treating a substrate in a predetermined substrate treating region, comprising:

spin support means for holding and rotating a substrate in a horizontal posture;

a plurality of holder arms arranged radially around said substrate treating region each pointing toward the center of said substrate, and each having a treating device attached to a distal end thereof for treating said substrate; and arm drive means for moving each of said holder arms to set said treating device to a position for treating said substrate;

wherein said arm drive means is operable to maintain said holder arms in a substantially horizontal posture at a standby position separate from said substrate treating region when said treating devices are not in use for substrate treatment, and for moving each of said holder arms straight toward the center of said substrate to set said treating device to the position for treating said substrate in time of substrate treatment.

17. A substrate treating apparatus as defined in claim 16, wherein said treating device comprises a treating solution supplying nozzle for supplying a treating solution to said substrate in said substrate treating region.

18. A substrate treating apparatus as defined in claim 16, wherein said treating device comprises a cleaning brush for cleaning said substrate in said substrate treating region.

19. A substrate treating apparatus for treating a substrate in a predetermined substrate treating region, comprising:

spin support means for holding and rotating a substrate in a horizontal posture;

a plurality of holder arms positioned in an arcuate array around said substrate treating region, each holder arm having a treating device attached to a distal end thereof for treating said substrate; and a plurality of arm drive mechanisms for maintaining said holder arms in a substantially vertical posture at a standby position separate from said substrate treating region when said treating devices are not in use for substrate treatment, and for turning each of said holder arms to a substantially horizontal posture to position said treating device for treating said substrate, wherein said arm drive mechanisms are operable to maintain said holder arms in said substantially vertical posture in said standby position laterally offset from but adjacent to said substrate treating region when said attached treating device is not in use, and for turning said holder arms to said substantially horizontal posture, by raising said holder arms from said standby position and tilting said holder arm toward said substrate treating region, to move said attached treating device to the position for treating said substrate.

* * * * *